US007195186B2

(12) United States Patent
Van Mullem

(10) Patent No.: US 7,195,186 B2
(45) Date of Patent: Mar. 27, 2007

(54) WEAR PROTECTION FOR A ROCK CRUSHING SYSTEM

(75) Inventor: Albert J. Van Mullem, Sussex, WI (US)

(73) Assignee: Sandvik Intellectual Property AB, Sandviken (SE)

( * ) Notice: Subject to any disclaimer, the term of this patent is extended or adjusted under 35 U.S.C. 154(b) by 723 days.

(21) Appl. No.: 09/758,680

(22) Filed: Jan. 11, 2001

(65) Prior Publication Data

US 2002/0170994 A1 Nov. 21, 2002

(51) Int. Cl.
*B02C 2/00* (2006.01)

(52) U.S. Cl. ..... 241/207; 29/402.08; 241/300; 241/261.1

(58) Field of Classification Search ..... 241/300, 241/261.1, 207–216; 29/402.08, 402.11, 29/402.12

See application file for complete search history.

(56) References Cited

U.S. PATENT DOCUMENTS 1,776,454 A * 9/1930 Symons ..... 241/299
2,594,080 A * 4/1952 Shafter ..... 241/299
3,860,184 A * 1/1975 Acton ..... 241/275
3,924,815 A 12/1975 Haggren
4,179,076 A 12/1979 Barrot et al.
4,384,684 A 5/1983 Karra
4,410,143 A 10/1983 Polinski
4,467,971 A 8/1984 Schuman
4,478,373 A 10/1984 Gieschen
4,519,551 A 5/1985 Ceurvorst
4,616,787 A * 10/1986 Kirsten ..... 241/275
4,659,026 A 4/1987 Krause et al.
4,750,679 A 6/1988 Karra et al.
5,022,593 A 6/1991 Stelk
5,031,843 A 7/1991 Motz
5,080,294 A 1/1992 Dean
5,372,318 A 12/1994 Jacobson
5,769,340 A 6/1998 Jean
5,775,607 A 7/1998 Bayliss et al.
5,803,382 A 9/1998 Ganser, IV et al.
5,810,269 A 9/1998 Shannon
5,915,638 A 6/1999 Jean
5,934,583 A 8/1999 Jean
5,938,133 A 8/1999 Bayliss et al.
5,944,265 A 8/1999 Ganser, IV et al.
5,964,422 A 10/1999 Ruokonen et al.
5,996,916 A 12/1999 Musil
6,007,009 A 12/1999 Sheridan et al.

* cited by examiner

*Primary Examiner*—Mark Rosenbaum
(74) *Attorney, Agent, or Firm*—Drinker Biddle & Reath LLP

(57) ABSTRACT

A segmented wear resistant band for protecting a surface subject to wear in a crusher is comprised of segments or concaves. The segments of the wear resistant band can be separated from each other by portions of reduced thickness. The portions of reduced thickness can be cut after the installation to the surface. The segments can also include a flange for reception in a recess between a spider and the top shell of a gyratory crusher.

21 Claims, 3 Drawing Sheets

WEAR PROTECTION FOR A ROCK CRUSHING SYSTEM

FIELD OF THE INVENTION

The present invention relates to rock crushers or crushing systems utilized for comminuting or breaking rock, coal, waste, and ore-like materials. Certain elements of such crushers are subjected to considerably more wear than others, particularly from contact with the material being crushed. These elements are frequently protected by more wear resistance components, which components are designed to be replaceable.

BACKGROUND OF THE INVENTION

One form of crusher which is frequently used for crushing or comminuting minerals, rock, coal, waste and other ore-like materials is a conical crusher. The conical crusher has a downwardly expanding central conical member which rotates or gyrates within an outer downwardly expanding frustroconically shaped member typically called a bowl. The central conical member generally has a wearing cover or liner typically called a mantle. The outside surface of the mantle provides a crushing surface for the rock crusher. The bowl is also provided with a wearing cover or liner, which forms the other crushing surface.

Another form of crusher which is frequently utilized for primary crushing operations is a gyratory crusher. The gyratory crusher has a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle. The mantle can be one or more pieces. The outside surface of the mantle provides a crushing surface for the rock crusher. The shell is also protected by a wearing cover or liner which provides the other crushing surface.

Conventional wearing covers or liners disposed over the shell are comprised of four-sided segments formed with a curvature appropriate to fit against the cylindrical surface of the shell. Liners formed from segments are utilized as opposed to one-piece liners. Liners formed from segments reduce susceptibility to breaking and bending caused by crushing forces and imperfect dimensional fits resulting from casting tolerances. The segments are typically called concaves and are formed of cast or fabricated steel.

The concaves are manually attached to the inside surface of the shell. A backing material, such as zinc, epoxy, or other adhesive, holds the concaves to the inside surface, fills gaps, and provides a uniform support surface. Concaves generally have a curvilinear outside and inside surface. The outside surface faces the inside surface of the shell, and the inside surface is the crushing surface that is opposite the mantle. Concaves can be arranged in rows over the inside surface of the top shell and the bottom shell of the gyratory crusher. For example, one type of gyratory crusher manufactured by Nordberg, Inc. of Milwaukee, Wis. can have five rows of concaves covering a top shell and a bottom shell.

The outside surface of each concave typically includes a recessed portion between the feet or outer bands. The recessed portion provides a gap between the outside surface of the concave and the inside surface of the top shell. Backing material is placed in the recessed portion or gap between the shell and the concave.

Installing the relatively small concaves is labor intensive and increases the cost associated with repairing and assembling rock crushers. The application of the concaves is time consuming, and improperly installed elements can be subject to loosening and falling out. In addition, the concaves must be positioned on the inside surface of the shell so that the concaves do not interfere with the operation of other elements, such as, the spider, the mantle, or other structures.

Thus, it is desirable to provide wear resistant segments or concaves in a form which are not susceptible to bending or breaking and yet can be more easily installed. Further, there is a need for concaves which are more easily aligned when installed. Further, there is a need for a concave which is less susceptible to movement in a vertical direction.

SUMMARY OF THE INVENTION

An exemplary embodiment relates to a wear resistant band for providing a wear protection surface over an inside surface of a member in a rock crusher. The wear resistant band includes a cast piece that includes curvilinear segments. The curvilinear segments are separated from each other by a portion of reduced thickness. The portion of reduced thickness can be cut to separate the curvilinear segments after installation to the inside surface of the member in the rock crusher.

Another embodiment relates to a wear protection arrangement for a surface of a rock crusher. The wear protection arrangement protects the surface from wear. The surface supports a crushing operation of the rock crusher. The wear protection arrangement includes curvilinear segments connected by a portion of reduced thickness.

Still another embodiment relates to a method of repairing or manufacturing a rock crusher. The rock crusher has a shell. The shell is exposed to wear when the rock crusher is operational. The method includes the step of attaching a one piece wear band including segments to the shell.

Still another exemplary embodiment relates to a concave for a gyratory crusher. The gyratory crusher includes a shell and a spider. The shell has a concave surface. The shell and the spider define a recess. The concave includes a top end having a flange and lip. The flange is configured to be received in the recess. The lip extends above the flange.

A still further embodiment relates to a gyratory crusher including a top shell, a spider disposed over a shell, and a concave. The shell and the spider define a recess. The concave covers at least a portion of the shell. The concave includes a top end having a flange and a lip. The flange is configured to be received in a recess. The lip extends above the flange.

Yet another embodiment relates to a method of repairing or assembling a gyratory rock crusher including a spider and a shell. The method includes placing a concave element on a rim of the shell, and disposing the spider over the shell. The concave element includes a flange and a lip. The flange rests on the rim of the shell. Disposing the spider over the shell captures the flange between the spider and the rim of the shell.

BRIEF DESCRIPTION OF THE DRAWINGS

Exemplary embodiments will hereafter be described with reference to the accompanying drawings, wherein like numerals denote like elements.

DETAILED DESCRIPTION OF THE PREFERRED EMBODIMENT

Figure 1:
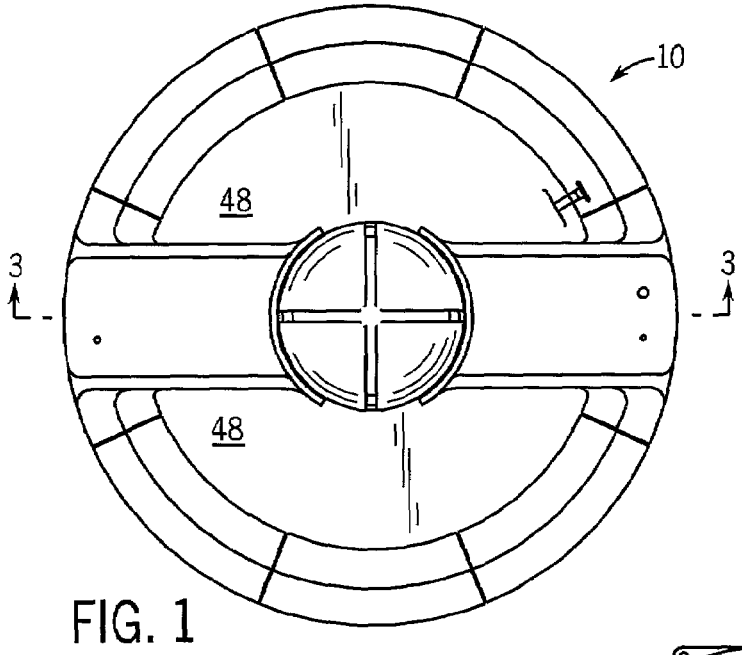
FIG. 1 is a planar top view of a gyratory crusher having concaves in accordance with an exemplary embodiment of the present invention.
Figure 2:
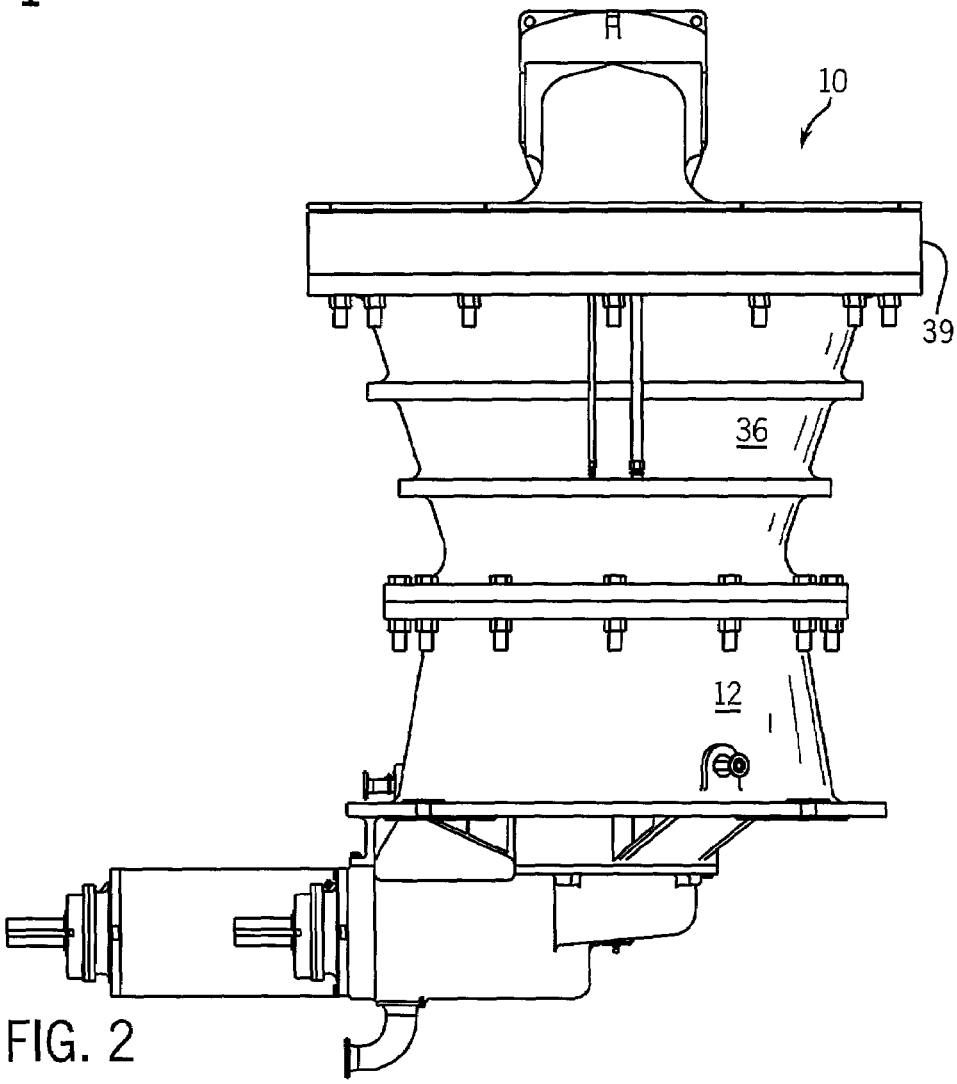
FIG. 2 is a planar side view of the gyratory crusher illustrated in FIG. 1.
Figure 3:
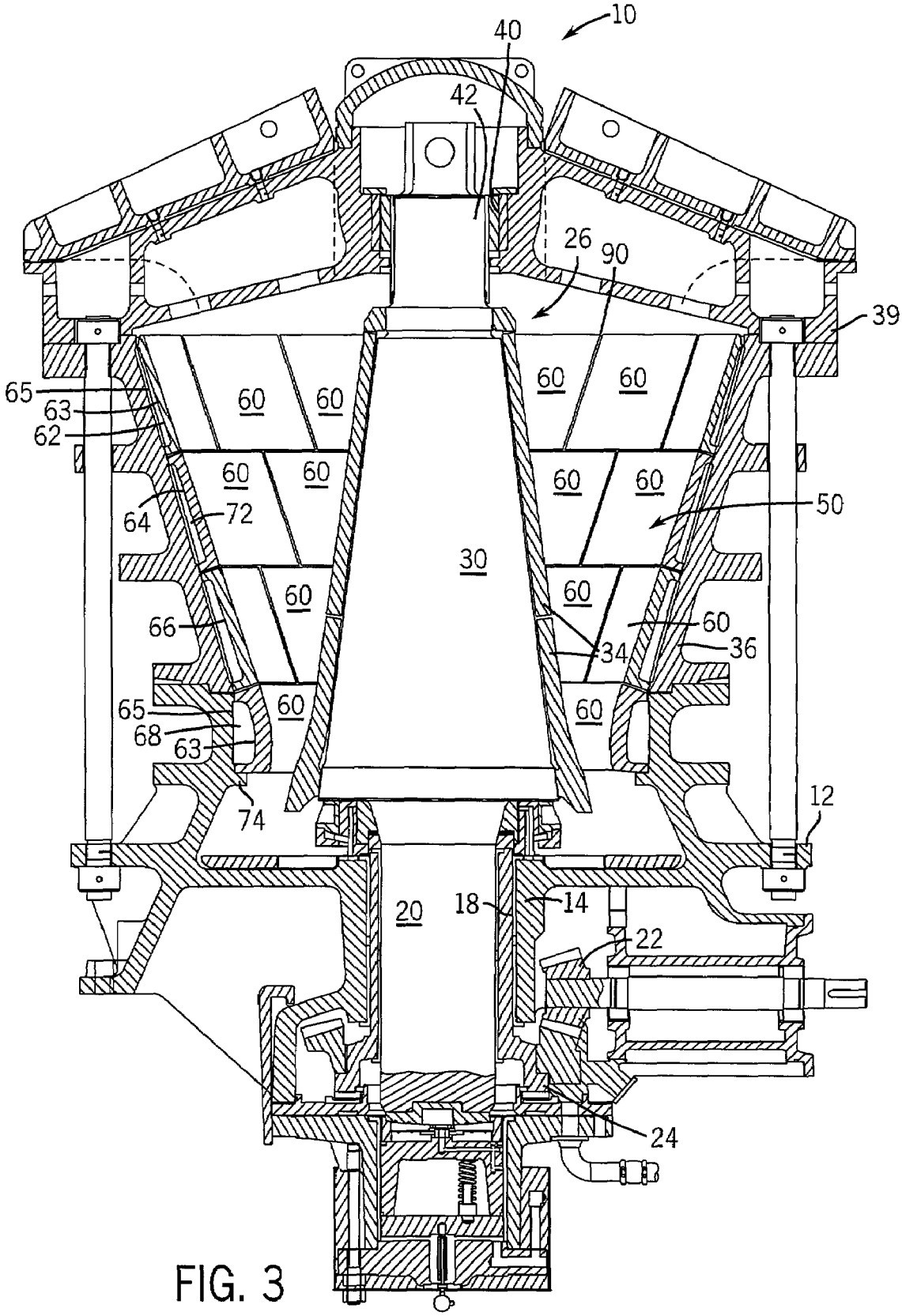
FIG. 3 is a cross-sectional view of the gyratory crusher illustrated in FIG. 1 about line 3—3 of the gyratory crusher, showing concaves in accordance with exemplary embodiments of the present invention.

Referring to FIGS. 1, 2 and 3, a gyratory crusher 10 can be utilized to crush rock, ore, minerals, waste, or other material. Gyratory crusher 10 is assembled on a cast steel base or bottom shell 12 having a central hub 14. Central hub 14 is provided with cylindrical vertical bore 18 adapted to receive a cylindrical support shaft 20. Pinion drive mechanism 22 causes rotation of an eccentric 24 which directs the gyratory motion of the shaft 20.

A head assembly 26, which is part of the shaft 20, includes a head member 30 which is covered by a two-piece mantle 34. Mantle 34 provides one of the crushing surfaces of crusher 10.

A top shell 36 projects upwardly from bottom shell 12 and is covered by a spider assembly including a spider 39. Alternatively, top shell 36 and bottom shell 12 can be a single piece component. Spider 39 includes an aperture 40 that receives an end 42 of shaft 20. Vertical positioning of shaft 20 with respect to top shell 36 adjusts the relative position of the mantle 34 of the head assembly 26 with respect to concaves 60, thereby adjusting the size of the crushed material exiting crusher 10. Concaves 60 are discussed below in greater detail with reference to FIGS. 4–6.

Material to be crushed is supplied through spider 39 which includes openings 48 for entry of the material into crushing cavity 50. A liquid flush apparatus (not shown) may be provided for spraying a liquid, such as, water toward the crusher cavity 50.

Top shell 36 and portions of bottom shell 12 are protected from wear by several rows of bands or concaves 60. Concaves 60 can be any type of polygons, such as, four sided or three sided polygons and can be in the shape of rectangles, squares, trapezoids, triangles, parallelograms or other polygons. Concaves 60 are arranged in rows 62, 64, 66 and 68. Concaves 60 have a convex frusto-conical outer surface 63 which faces an inner surface or mounting surface 65 of shells 36 and 12. A recess 72 is provided in each concave 60. The top and bottom shells together form an outer container. Recess 72 provides a gap between outer surface 63 of concave 60 and inner surface 65 of shells 36 and 12 for backing material, such as, concrete or other adhesive.

Vertically adjacent rows 62, 64, and 66 cover an entire inner surface 65 of top shell 36, and row 68 may cover a portion of inner surface 65 of bottom shell 12. The concaves include a concave frusto-conical inner surface 164. The surfaces 164 of all of the concaves together form a concave frusto-conical crushing surface that is coaxial with a vertical axis A of the mounting surface 65. Concaves 60 associated with row 68 may be supported by a flange 74 of bottom shell 12 or a support attached to bottom shell 12 or to top shell 36. Row 66 of concaves 60 is supported by row 68 of concaves 60. Row 64 of concaves 60 is supported by row 66 of concaves 60, and row 62 of concaves 60 is supported by row 64. Flange 84 (shown in FIG. 4) also supports row 62 of concaves 60.

Concaves 60 are shown in FIG. 3 as separate pieces. However, to advantageously reduce manufacturing and maintenance costs, concaves 60 can be installed in unitary pieces including two or more concaves 60 separated by a portion having a reduced thickness, created by the insertion of furrows or grooves 90, discussed in greater detail with reference to FIGS. 5 and 6. Grooves 90 can be cut though by a welding torch or a mechanical saw after installation of concaves 60 to inner surface 65 of shells 12 and 36. Concaves 60 can be formed of a ceramic material, or an iron based material.

Figure 4:
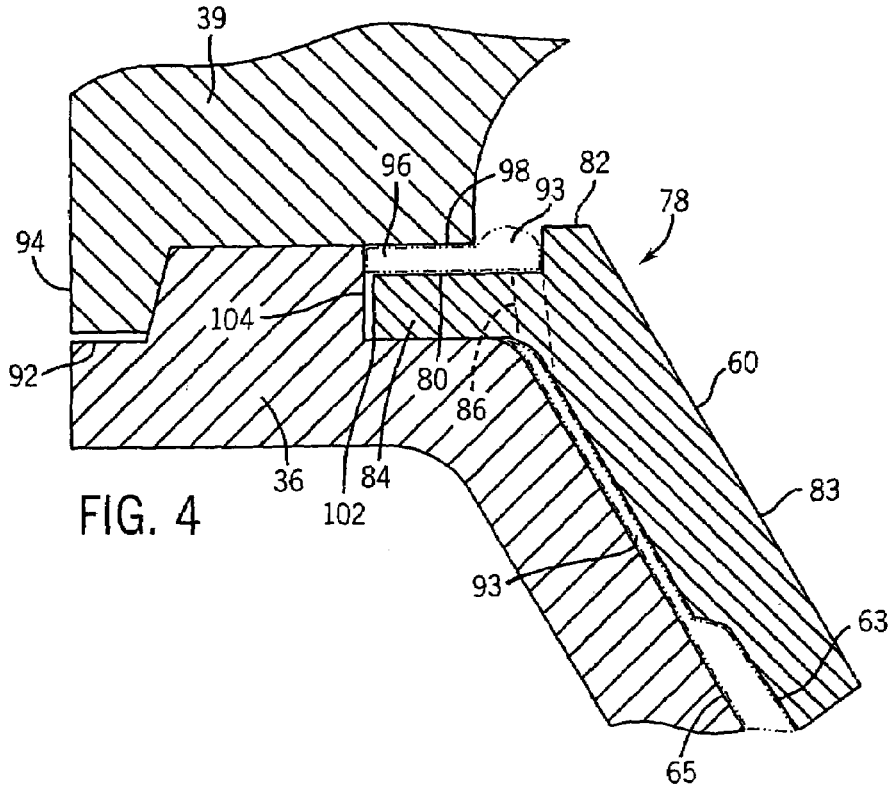
FIG. 4 is a more detailed cross sectional view of one of the concaves illustrated in FIG. 3, showing a flange in accordance with one alternative embodiment.

In FIG. 4, a more detailed drawing of one of concaves 60 in row 62 (FIG. 3) is shown. Concave 60 includes a top end 78 which includes a lip 82 and a flange 84. Top end 78 also includes an aperture 86 through which backing material 93 can be poured between inner surface 65 of top shell 36 and outer surface 63 of concaves 60.

Spider 39 can be attached or rest upon top shell 36. Preferably top shell 36 includes a recessed portion 92 for receiving a flange 94 of spider 39. In addition, spider 39 and top shell 36 define a recess 96 for capturing flange 84 of concaves 60. Backing material 93 can also be provided within recess 96. Recess 96 is defined by bottom surface 98 of spider 39 and a rim 102 of top shell 36 and a perpendicular wall 104 of top shell 36. The backing material 93 eliminates clearance between the concave 60 and the top shell 36 and spider 39.

Flange 84 of concaves 60 prevents concaves 60 from sliding vertically (e.g., downward). Lip 82 is preferably 1.5 inches higher than a top surface 80 of flange 84, and one inch higher than the bottom surface 98 of spider 39. In the preferred embodiment, lip 82 is integral with concaves 60. However, in an alternative embodiment, lip 82 could be a temporary structure made of any suitable material. Flange 84 is preferably three inches wide and two inches thick. The flange 84 may be segmented along the length of concaves 60. The segmented structure creates a natural aperture 86 in the form of a slot. When the flange 84 is not segmented, aperture 86 is preferably one inch in diameter. Concave 60 shown in FIG. 4 is preferably three inches thick from surface 63 to a crushing surface 83.

Flange 84 and lip 82 advantageously allow backing to be poured into the gap between spider 39 and lip 82 and through aperture 86 without spilling onto crushing surface 83 of concave 60. Thus lip 82 can be made of any material that prevents spillage onto crushing surface 83. Flange 84 also advantageously eliminates the potential for concave movement. Thus, flange 84 provides positive positioning and stable support. Flange 84 prevents concaves 60 from falling during installation and provides absolute vertical restraint.

Figure 5:
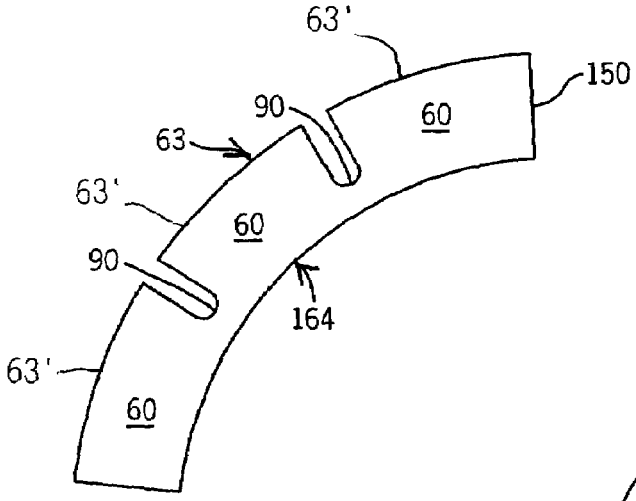
FIG. 5 is a more detailed cross sectional view of a one of the concaves illustrated in FIG. 3, showing grooves on an outside surface in accordance with another alternative embodiment.

With reference to FIG. 5, several concaves 60 (FIG. 3) are shown as a one-piece casting 150. Concaves 60 are curvilinear segments separated by portions having a reduced thickness, created by the insertion of slits or grooves 90 disposed in the outer surface 63. The outer surface includes convex frusto-conical surface portions 63' separated by the groove 90. Each groove 90 has a dimension (i.e., length) in a first direction which intersects the inner and outer surfaces 164, 63, a dimension (i.e., width) in a second direction which extends in a circumferential direction of the band. The dimension in the first direction is greater than the greatest dimension in the second direction. Also, each groove extends completely through a band in a third direction (i.e., height) oriented transversely relative to both of the first and second directions, i.e., perpendicular to the sheet on which FIG. 5 is drawn. A one-piece casting can be utilized in any of rows 62, 64, 66 or 68 (FIG. 3). Preferably, a one-piece casting 150 covers an arc length of at least 45°. One-piece casting 150 cane applied in one of rows 62, 64, 66 and 68. After application to inner surface 65 of top shell 36 or bottom shell 12, concaves 60 may be separated by cutting either mechanically or with a heat torch along grooves 90. One-piece casting 150 is cut to reduce the potential for bending and breakage due to crushing forces and imperfect dimension fits resulting from casting tolerances.

Alternatively, one-piece casting 150 may be constructed without grooves 90. Concaves 60 may still be separated by cutting either mechanically or with a heat torch into the desired number of segments after installation if desired.

As a further alternative, one-piece casting 150 may be utilized without cutting into a number of separate concaves 60 after installation. This alternative may be preferred with respect to row 68.

In the exemplary embodiment in FIG. 5, grooves 90 extend vertically. However, horizontal grooves could also be utilized. Generally, casting 150 can be made as large as possible including a large group (two or more) of concaves 60. For example, in sections of shells 12 and 36 which are narrower, casting 150 can cover an entire 360° arc. In another alternative embodiment, casting 150 can cover an arc length of 180° or 90°. Preferably, segments 60 are twenty inches high and twenty inches wide. Concaves 60 are preferably cast steel. Concaves 60 are one inch thick at grooves 90 and three inches thick at locations outside of grooves 90.

Figure 6:
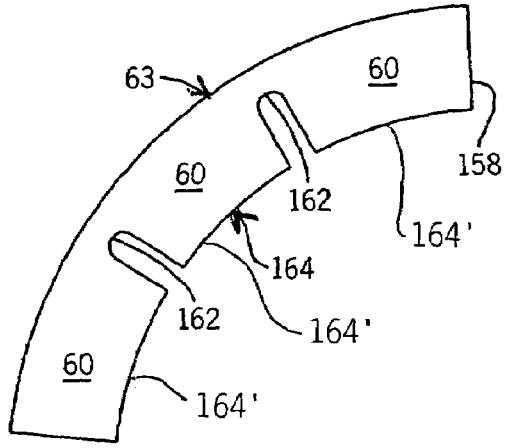
FIG. 6 is a more detailed cross sectional view of a one of the concaves illustrated in FIG. 3, showing grooves on an inside surface in accordance with yet another exemplary embodiment.

In FIG. 6, a casting 158 similar to casting 150 is shown. Casting 158 includes grooves 162 on an inside surface 164 of concaves 60. Each groove 162 has a dimension (i.e., length) in a first direction which intersects the inner and outer surfaces 164, 63, a dimension in a second direction (i.e., width) which extends in the circumferential direction of the band. The dimension in the first direction is greater than the greatest dimension in the second direction. Also, each grooves extends completely through the band in a third direction (i.e., height) oriented transversely relative to both of the first and second directions, i.e., perpendicular top the sheet on which FIG. 6 is drawn. The inside surface 164 includes concave frusto-conical surfaces separated by the groove. When grooves 162 are located on the inside surface 164, it may not be necessary to separate concaves 60 by cutting along grooves 162. Under wear, manganese steel, a typical concave 60 material, tends to expand. Grooves 162 will allow the expansion of casting 158 by closing grooves 162. Thus, growth can be allowed until grooves 162 close completely, creating a solid ring of concaves 60, then requiring cutting to relieve the resultant stress on the machine. The size of castings 150 and 158 are only limited by the manageable sizes for transportation and foundry operations. Grooves 162 are on the order of one half inch wide and concaves 60 are on the order of one inch thick at grooves 162 and three inches thick at locations outside of grooves 162.

While one embodiment of the invention has been shown, it should be apparent to those skilled in the art that what has been described is considered at present to be a preferred embodiment of a wear band for a crusher. However, in accordance with the patent statutes, changes may be made in the wear resistant band without actually departing from the true spirit and scope of this invention. The wear band or concaves can be utilized on a variation of crusher components and within different types of crushers. The appended claims are intended to cover all such changes and modifications which fall within the true spirit and scope of this invention.

What is claimed is:

1. A method of forming a crushing surface of a rock crusher, the rock crusher comprising an outer container forming a concave inner crushing surface defining a vertical axis, and an inner member arranged interiorly of the inner surface, wherein material to be crushed passes downwardly between the crushing surface and the inner member, the crushing surface formed by a method comprising the steps of:

A) arranging over a concave inner mounting surface of the container a circumferentially extending wear-resistant band, the banding having an inner surface extending at least partially around the circumference of the mounting surface; thereafter B) cutting through the band to separate the concave into a plurality of circumferentially adjacent segments; and C) leaving the segments in place on the mounting surface to define the concave inner crushing surface.

2. The method according to claim 1 wherein step A comprises arranging a plurality of vertically adjacent bands over the mounting surface, and step B comprises cutting through each band.

3. The method according to claim 2 wherein each band extends less than the entire circumference of the mounting surface, and further including the step of arranging over the mounting surface a plurality of circumferentially adjacent bands, and step B comprises cutting through each of the bands.

4. The method according to claim 1 wherein each band extends less than the entire circumference of the mounting surface, and further including the step of arranging over the mounting surface a plurality of circumferentially adjacent bands, and step B comprises cutting through each of the bands.

5. The method according to claim 1 wherein the band includes at least one portion of reduced thickness, wherein the cutting of step B is performed through the reduced thickness portion.

6. The method according to claim 5 wherein the portion of reduced thickness is formed by a groove disposed in an outer surface of the band.

7. The method according to claim 5 wherein the band is frusto-conical, the portion of reduced thickness being formed by a groove disposed in the inner surface of the band, the inner surface of the band comprising frusto-conical surface portions spaced apart by the groove.

8. The method according to claim 1 wherein the band forms an arc of 360 degrees.

9. The method according to claim 1 wherein the band forms an arc of at least 180 degrees.

10. The method according to claim 1 wherein the band forms an arc of at least 90 degrees.

11. The method according to claim 1 wherein step B comprises cutting through the band at least two times to separate the band into at least three segments.

12. The method according to claim 1 wherein the mounting surface is of frusto-conical shape, and the band is of correspondingly frusto-conical shape.

13. A method of forming a crushing surface of a rock crusher, the rock crusher comprising an outer container forming a concave frusto conical inner crushing surface defining a vertical axis, and an inner member arranged interiorly of the inner surface and including a convex crushing surface facing the inner crushing surface to form therebetween an annular gap which becomes narrower toward a bottom end of the gap, wherein the material to be crushed passes downwardly within the gap, wherein the convex crushing surface is of convex curvature as viewed in a direction parallel to the vertical axis and extends substantially 360 degrees, the inner crushing surface formed by arranging over a concave inner frusto-conical mounting surface of the container a circumferentially extending wear-resistant band, the band including: a concave frusto-conical inner surface extending at least partially around the circumference of the mounting surface, a convex frusto-conical outer surface facing the mounting surface, and a groove formed in one of the inner and outer surfaces of the band and extending toward, and stopping short of, the other of the inner and outer surfaces of the band, wherein the one surface includes frusto-conical surface segments separated by the groove, the groove including a dimension in a first direction intersecting the inner or outer surfaces, and a dimension in a second direction extending circumferentially, wherein the dimension in the first direction is greater than the greatest dimension in the second direction, each groove extending completely through the band in a third direction extending transversely relative to both of the first and second directions.

14. A wear resistant band adapted to be mounted on an inner mounting surface of a rock crusher, the band comprising a frusto-conical body forming an arc of at least 90 degrees and including a concave frusto-conical inner surface and a convex frusto-conical outer surface, the distance from the inner surface to the outer surface defining a thickness of the band, one of the inner and outer surfaces including a groove extending toward the other of the inner and outer surfaces and stopping short of such other surface to form a portion of reduced thickness in the body, wherein the one surface includes frusto-conical surface segments separated by the groove, the groove including a dimension in a first direction intersecting the inner or outer surfaces, and a dimension in a second direction extending circumferentially, wherein the dimension in the first direction is greater than the greatest dimension in the second direction, each groove extending completely through the band in a third direction extending transversely relative to both of the first and second directions.

15. The wear-resistant band according to claim 14 wherein the groove is disposed in the outer surface.

16. The wear-resistant band according to claim 14 wherein the groove is disposed in the inner surface.

17. The wear-resistant band according to claim 14 wherein the band forms an arc of at least 180 degrees.

18. The wear-resistant band according to claim 14 wherein the band forms an arc of at least 360 degrees.

19. The wear-resistant band according to claim 14 wherein the band comprises a ceramic material.

20. The wear-resistant band according to claim 14 wherein the band comprises iron.

21. The wear-resistant band according to claim 14 wherein the band includes an additional groove disposed in the one surface.

* * * * *